US010569445B2

(12) United States Patent
Lüttich

(10) Patent No.: US 10,569,445 B2
(45) Date of Patent: Feb. 25, 2020

(54) STAPLING DEVICE WITH EXCHANGEABLE DRIVING TOOL

(71) Applicant: Andreas Lüttich, Rauenberg (DE)

(72) Inventor: Andreas Lüttich, Rauenberg (DE)

(73) Assignee: Andreas Lüttich, Rauenberg (DE)

( * ) Notice: Subject to any disclaimer, the term of this patent is extended or adjusted under 35 U.S.C. 154(b) by 0 days.

(21) Appl. No.: 15/526,746

(22) PCT Filed: Nov. 5, 2015

(86) PCT No.: PCT/DE2015/200495
§ 371 (c)(1),
(2) Date: May 12, 2017

(87) PCT Pub. No.: WO2016/074676
PCT Pub. Date: May 19, 2016

(65) Prior Publication Data

US 2017/0368711 A1 Dec. 28, 2017

(30) Foreign Application Priority Data

Nov. 14, 2014 (DE) ..... 10 2014 223 312
Apr. 2, 2015 (DE) ..... 10 2015 206 102

(51) Int. Cl.
*B27F 7/21* (2006.01)
*B27F 7/19* (2006.01)
(Continued)

(52) U.S. Cl.
CPC ..... *B27F 7/19* (2013.01); *B27F 7/21* (2013.01); *B27F 7/36* (2013.01); *B42B 4/00* (2013.01); *B25C 5/0278* (2013.01); *B25C 5/15* (2013.01)

(58) Field of Classification Search
CPC ..... B27F 7/19; B27F 7/21; B27F 7/36; B42B 4/00; B65H 37/04
See application file for complete search history.

(56) References Cited

U.S. PATENT DOCUMENTS 6,565,075 B2 * 5/2003 Ishizaki ..... B27F 7/19 227/128
6,735,415 B2 * 5/2004 Isobe ..... G03G 15/6541 270/58.08
(Continued)

FOREIGN PATENT DOCUMENTS

BE 417726 A * 11/1936
BE 527593 A 4/1956
(Continued)

OTHER PUBLICATIONS

International Search Report for PCT/DE2015/200495 dated Feb. 16, 2016.
Chinese Search Report dated Oct. 19, 2018 for Chinese application No. 201580061574.2.

*Primary Examiner* — Patrick H Mackey
(74) *Attorney, Agent, or Firm* — McDonnell Boehnen Hulbert & Berghoff LLP

(57) ABSTRACT

The invention relates to a device for stapling printed products, preferably automatically, comprising a stapling head for driving a staple through a printed-product back and a bender for bending the open ends of the staple. Said device is characterized in that the stapling head has a modular design, wherein the stapling head comprises a driving tool (1) and a driving-tool holder (2) for equipping with the driving tool, and wherein the driving tool can be fastened to the driving-tool holder in an exchangeable manner, e.g., by means of locking bolts (3) fastened to a crossmember (4) or by means of a groove (5)/feather-key connection. The invention further relates to a corresponding stapling head.

17 Claims, 6 Drawing Sheets

Figure 1:
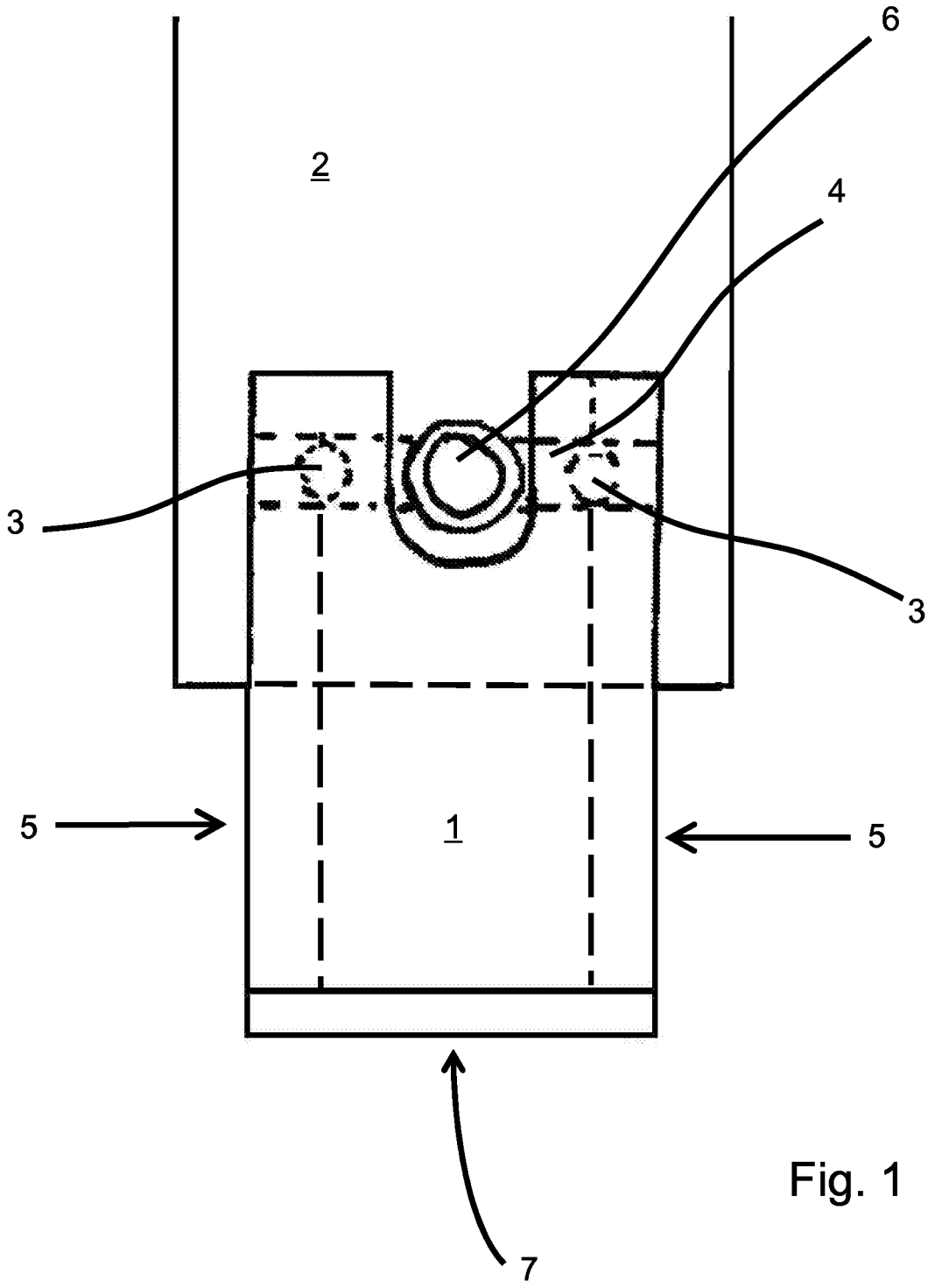

(51) Int. Cl.

| | |
|---|---|
| ***B42B 4/00*** | (2006.01) |
| ***B27F 7/36*** | (2006.01) |
| *B25C 5/02* | (2006.01) |
| *B25C 5/15* | (2006.01) |

(56) References Cited

U.S. PATENT DOCUMENTS

| | | | | |
|---|---|---|---|---|
| 6,736,388 | B2 * | 5/2004 | Lawrence | B65B 27/08 270/58.07 |
| 7,121,541 | B2 * | 10/2006 | Saito | B27F 7/19 270/58.09 |
| 2003/0044209 | A1 * | 3/2003 | Isobe | B42C 1/12 399/410 |
| 2007/0220730 | A1 | 9/2007 | Hoffmann et al. | |
| 2010/0225041 | A1 * | 9/2010 | Matsuyama | B42B 4/00 270/37 |

FOREIGN PATENT DOCUMENTS

| | | | |
|---|---|---|---|
| CN | 1288801 | A | 3/2001 |
| CN | 101282827 | A | 10/2008 |
| CN | 202035559 | U | 11/2011 |
| CN | 103967882 | A | 8/2014 |
| DE | 3640529 | A1 | 6/1988 |
| DE | 202006020433 | U1 | 7/1995 |
| DE | 10024113 | A1 | 1/2002 |
| DE | 4444220 | A1 | 7/2008 |
| DE | 10 2008 005014 | A1 | 7/2009 |
| EP | 1629992 | A1 | 3/2006 |
| JP | 57030009 | A | 2/1982 |
| JP | 10151582 | A | 6/1998 |
| JP | 2004238108 | A | 8/2004 |
| JP | 2006151592 | A | 6/2006 |
| JP | 2009226909 | A | 10/2009 |

* cited by examiner

STAPLING DEVICE WITH EXCHANGEABLE DRIVING TOOL

This application is a U.S. National Phase Application pursuant to 35 U.S.C. § 371 of International Application No. PCT/DE2015/200495 filed Nov. 5, 2015, which claims priority to German Patent Application Nos. 10 2014 223 312.7 filed Nov. 14, 2014 and 10 2015 206 102.7 filed Apr. 2, 2015. The entire disclosure contents of these applications are herewith incorporated by reference into the present application.

The invention relates to a device for stapling, preferably automatically, printed products, having a stapling head for driving a staple through a printed product back and having an anvil for bending the free ends of the staple.

Furthermore, the invention relates to a stapling head for a device for stapling printed products.

Devices of the type under discussion, for stapling printed products, e.g. brochures, magazines, leaflets, catalogues, etc. have been known for years in the field. Merely by way of example, reference is made to EP 1 629 992 A1, which discloses a method for stapling printed products and a corresponding stapling device. According to the disclosure, individual printed sheets are assembled on the accumulating chain of a cumulative stapler, and conveyed in the form of a saddle to the stapling machine.

The known device has a stapling head and an anvil. The stapling head is disposed above the accumulating chain and the anvil is disposed beneath it. There is an intermediate space between the two in order that the printed product that is to be stapled can placed between these and stapled. The staples used for stapling are formed in the stapling head of the stapling device, which normally has a drive unit and an anvil. Concretely, a wire is supplied to the stapling head in a manner known per se, which is drawn from a roll. An appropriate piece is cut therefrom, and is bent into substantially a U-shape by the anvil, wherein the back of the staple is flat. This U-shaped piece is driven as a staple by the drive unit into the printed product that is to be stapled. The staple driven through the printed product is closed with the anvil. The anvil works together with the stapling head thereby and has flaps, with which the staple is closed.

It is problematic with the known device that the stapling head comprised by the device is exclusively suitable for stapling printed products with conventional staples. Conventional staples are substantially U-shaped staples thereby, having a straight back part. The known stapling head, or the known device is for a single type of staples, specifically for stapling with conventional staples.

Moreover, devices, or stapling heads for devices, are known in the field, with which a stapling of printed products is possible with eye-staples. The known devices are designed exclusively for eye-stapling due to their specialized construction.

Fundamentally, the stapling of preferably folded printed products can occur in an inline system of a digital printing machine. The stapling occurs thereby after the accumulation and assembly of the printed product inside the inline system of the digital printing machine. For this, the inline system has a stapling station, in which the folded sheets lying on type of one another are stapled together by means of a staple. This is accomplished by stapling heads, which are disposed above the accumulating position, and counterparts, specifically anvils, that are disposed beneath the accumulating position. The anvil bends the free ends of the staples penetrating the folded sheets, such that the staple is closed.

With the known devices for stapling printed products, it is particularly disadvantageous that—depending on the type of stapling head integrated in the device—only one type of stapling defined by the stapling head can be provided, i.e. either a stapling with eye-staples or a stapling with conventional U-shaped staples. Consequently, a complete system for stapling with U-shaped staples and a system for stapling with eye-staples must be kept available. This is particularly expensive and inefficient.

Furthermore, stapling devices are known in the field, wherein—depending on the application—the complete stapling head can be exchanged in the system. It is a significant disadvantage that an exchange of the complete stapling head is very labor intensive, complicated, and time consuming.

The present invention therefore addresses the objective of designing and further developing a stapling head of the type specified above, such that a more flexible and efficient use of the device is enabled with structurally simple means, in particular with regard to providing different types of stapling, with minimal set-up time.

In accordance with the invention, the above objective is achieved through the features of Claim 1. Accordingly, the device under discussion, for stapling printed products, is characterized in that the stapling head has a modular design, wherein the stapling head comprises a driving tool and a driving tool retainer that is to be equipped with the driving tool, and wherein the driving tool can be attached to the driving tool retainer such that it can be replaced.

The above objective is furthermore achieved by means of a stapling head having the features of Claim 14. Accordingly, a stapling head is defined, wherein the stapling head comprises a driving tool and a driving tool retainer that is to be equipped with the driving tool, wherein the driving tool is attached to the driving tool retainer such that it can exchanged in a modular manner.

It is acknowledged in accordance with the invention that it is of significant advantage when, with regard to a variable and flexible use of a stapling device, in particular for providing different types of stapling, as few components of the device as possible require a retooling or replacement. In accordance with the invention, the stapling head has a modular design, wherein the stapling head comprises a driving tool and a driving tool retainer that is to be equipped with the driving tool in a modular manner. The driving tool can be attached to the driving tool retainer thereby such that it can be replaced in a modular manner, and serves to drive a, potentially pre-shaped, staple into the back of a printed product. Accordingly, only the driving tool has to be exchanged in the framework of retooling the device in order to provide for a different type of stapling, i.e. a stapling that is to occur, for example, with a different type or design of staples. This can be quickly and easily accomplished due to the modular design.

As a result, a device for stapling printed products and a stapling head for such a device are defined, wherein a flexible use of the device with less retooling time is possible with structurally simple means, in particular with regard to providing different types of stapling with different types of staples.

In an advantageous manner, the supplying of the staple wire can occurs selectively via a wire coil/roll, or via a magazine containing pre-stamped wire or wire pieces. It is conceivable thereby that bending means are provided in the driving tool for shaping the wire, which pre-shape the staples that are to be driven, e.g. as conventional staples or as eye-staples. It is furthermore conceivable that pre-shaped staples, either conventional or eye-staples, are already provided in a magazine.

In a particularly advantageous manner, the driving tool can have, at least in part, a substantially plate-shaped design. In this manner, a space saving construction with sufficient stability can be obtained. It is conceivable thereby that the cross section of the driving tool tapers toward the undersurface for striking the staples. For practical purposes, an upper part of the driving tool may be designed with a greater thickness, or plate thickness, respectively, than a lower part toward the undersurface. In this manner, a secure and stable attachment in the driving tool retainer can be obtained, which is substantially connected/coupled to the upper part of the driving tool. The lower part of the driving tool can have an appropriately thin form as a result of a tapering design, such that in the region where the striking of the staples occurs, the supply of pre-shaped staples, for example, potentially from a storage magazine, can be accomplished in a structurally simple manner.

In an advantageous design, the driving tool can be placed or installed in the stapling head or in the driving tool retainer via a tongue and groove system. The driving tool retainer can be designed thereby, for example, such that the driving tool is at least partially inserted into the driving tool retainer, for example. This enables a stable and secure retaining of the driving tool. The driving tool retainer can be designed for this as a substantially box-shaped hollow body, such that the driving tool can be at least partially inserted or slid into the hollow body. In order to form the tongue and groove connection between the driving tool and the driving tool retainer, the driving tool can have a lateral recess, which interacts in a form-fitting manner with corresponding protruding guide pieces of the driving tool retainer, e.g. in the form of a projection. Furthermore, the projection—for forming the tongue—can also be formed on the driving tool, and the recess—for forming the groove—can be formed on the inner walls of the hollow driving tool retainer. For practical purposes, the driving tool can be connected to the driving tool retainer in a form-fitting manner, or can be at least partially inserted therein, such that a simple and secure positioning for coupling the driving tool to the driving tool retainer is ensured.

In a further advantageous manner, the driving tool can have at least one opening for attaching it to the driving tool retainer. As a result, the driving tool can be coupled to the driving tool retainer in a simple manner, wherein a driving tool retainer moving vertically during a stapling procedure transfers its movement to the driving tool. It is conceivable thereby that an opening/recess having a cross section that is not round is provided as the opening or passage, or as the recess, such that when only one opening or recess is provided, a twisting of the driving tool in relation to the driving tool retainer is prevented. Furthermore, for practical purposes, two or more openings or recesses—in each case having a cross section that is not round and/or is round—may be provided, such that a twisting is prevented and/or an improved stability and force transfer to the driving tool is ensured.

With regard to a simple and stable securing of the driving tool in the stapling head, the driving tool can be positioned or retained on the driving tool retainer by means of a mount, preferably extending over the horizontal width of the driving tool, and at least one bolt. The mount can also extend thereby over just a portion of the width of the driving tool. In a particularly advantageous manner, the at least on bolt can be designed as a projection on the mount, which engages in a recess in the driving tool for preferably a vertical securing thereof. The mount is attached to the driving tool retainer such that it can not move vertically. It is furthermore conceivable that the mount comprises one or more openings, which are substantially aligned over corresponding openings in the driving tool and/or driving tool retainer, such that the driving tool is retained on the driving tool retainer via bolts. The bolt(s) can be permanently attached to the mount thereby, and simply inserted into the respective openings in the driving tool and/or the driving tool mount.

In a further advantageous manner, the mount can be locked in place on the driving tool retainer by an interlocking means. The interlocking means can engage directly with the mount and the driving tool retainer thereby. As a result, a releasing of the driving tool from the driving tool retainer is effectively prevented, as long as the interlocking means provides a locked-in state. Alternatively or additionally, it is conceivable that a interlocking means engages directly with the driving tool, and thus locks the driving tool in place in the driving tool retainer. It is furthermore conceivable that numerous interlocking means are provided for securing the driving tool to the driving tool retainer.

Regarding a simple and multiple retooling of the stapling head, the interlocking means can be designed as a releasable connecting means. It is conceivable thereby that as an interlocking means, a screw connection is provided, e.g. a wing screw, a spring latching, a pawl latching and/or a quick-release clamp. In this manner, a quick-change mechanism is provided in a clever manner, which enables a quick and simple retooling of the stapling head.

In order to create an interlocking that is easy to operate, the interlocking means can have a motorized design. By way of example, an interlocking aid can be implemented with a motor and spindle.

For practical purposes, the motorized interlocking means can be operated via the software of the device, or the software control thereof, respectively. Consequently, a connection of the interlocking means and thus the implemented interlocking mechanism, can be provided in the software/machine software of the device, in order to control the interlocking via a control panel.

In an advantageous manner, the driving tool can have a recess and/or a through hole, or a passage, in the region of the interlocking means, wherein the recess and/or the hole is designed such that the interlocking means is disposed such that it does not come in contact with the driving tool. Thus, the recess can be formed, for example, on the edge of the driving tool, such that the driving tool can be removed from the stapling head, or released from the attachment in the stapling head after it has been disengaged.

With regard to a multifaceted and flexible application field of the device, the driving tool retainer can be equipped with different driver modules functioning as driving tools, wherein the different driver modules can be provided in each case for striking, or driving differently designed or differently shaped staples. The side of the driver module that serves to strike and drive the staple out can be designed for a specially shaped and formed staple thereby. Depending on the application, the driver module appropriate for the currently desired staple shape can be placed in the stapling head in a simple manner, due in particular to the modular design of the stapling head, specifically through securing or attaching it to the driving tool retainer.

In an advantageous design, a driver module may be provided as a driving tool for the driving tool retainer for striking, or for driving, a preferably pre-shaped staple having a straight back portion. A staple of this type corresponds to a generally known conventional stapling with staples having a substantially U-shaped construction. After the two legs of the staple have been driven with the driving tool through the printed product that is to be stapled, the legs passing through the printed product are closed by an anvil, or by bending means.

Moreover, as a driving tool for the driving tool retainer, a driver module may be provided for striking or for driving a preferably pre-shaped staple having an eyelet in the back portion of the staple. For this, the driving tool has a recess on its undersurface serving to strike the staple, preferably a striking edge, such that the driving tool is adapted appropriately to the eye-staple that is to be stapled.

In a particularly preferably manner, the appropriate driver module, depending on the desired type of staple, can be inserted in a modular manner into the driving tool retainer, serving as the driving tool.

In an advantageous design, a detection device may be provided for identifying the driving tool, or a driver module, respectively. By way of example, the driving tool retainer can comprise a detection device, which identifies the inserted and locked-in driving tool. For this, the driving tool can have appropriate encoding means, which can be detected or decoded by the detection device of the driving tool retainer. Electromagnetic and/or mechanical detection devices for identifying the driving tool are conceivable thereby. The driving tool could be equipped, for example, with an RFID chip, which can be read by an RFID reading device serving as a detection device for identifying the driving tool. As a result of the identification of the respective driving tool placed in the tool retainer, it is possible that potentially necessary fundamental adjustments that are to be set for the different driving tools are automatically carried out by the device.

Figure 2:
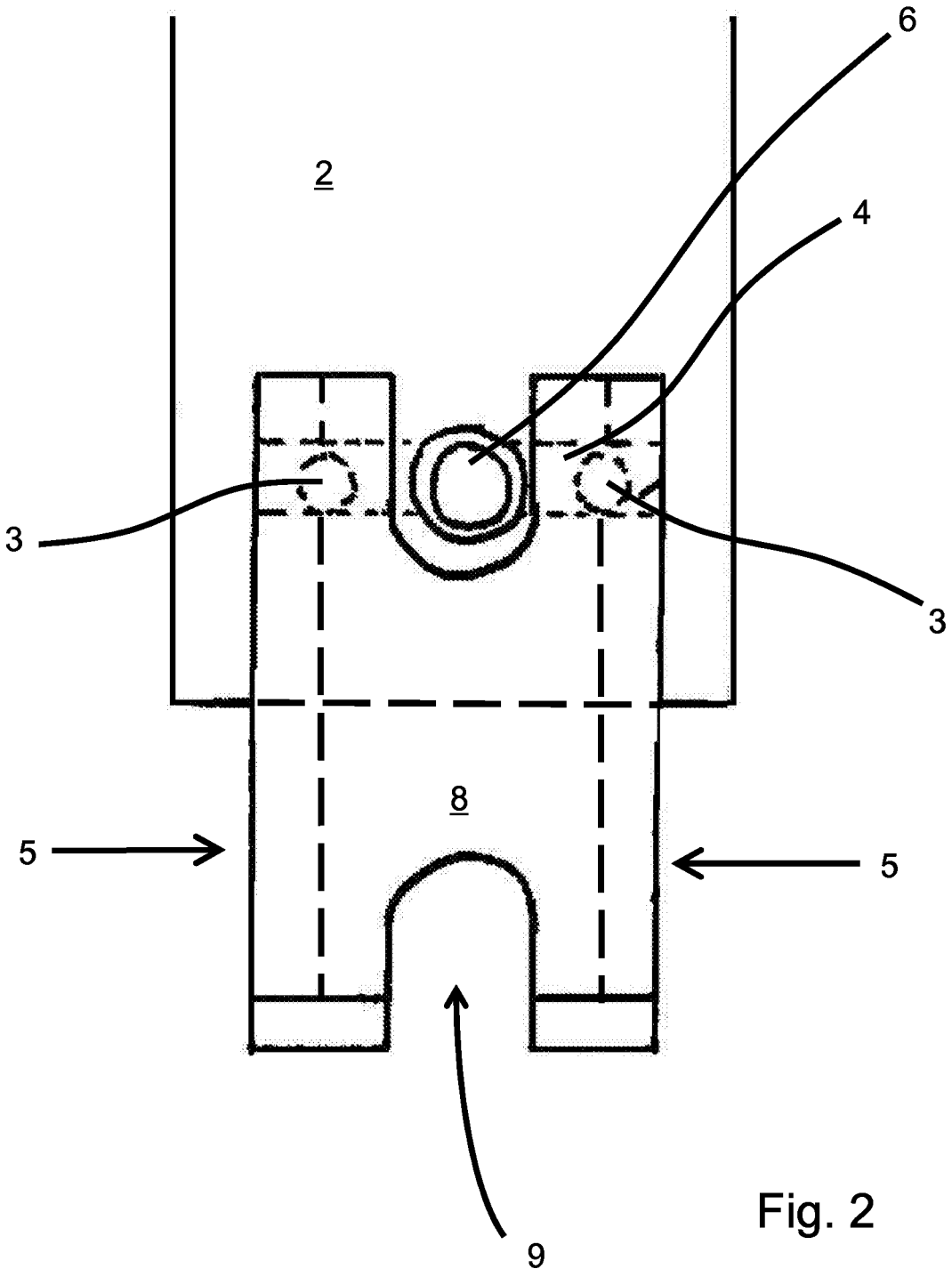
Figure 3:
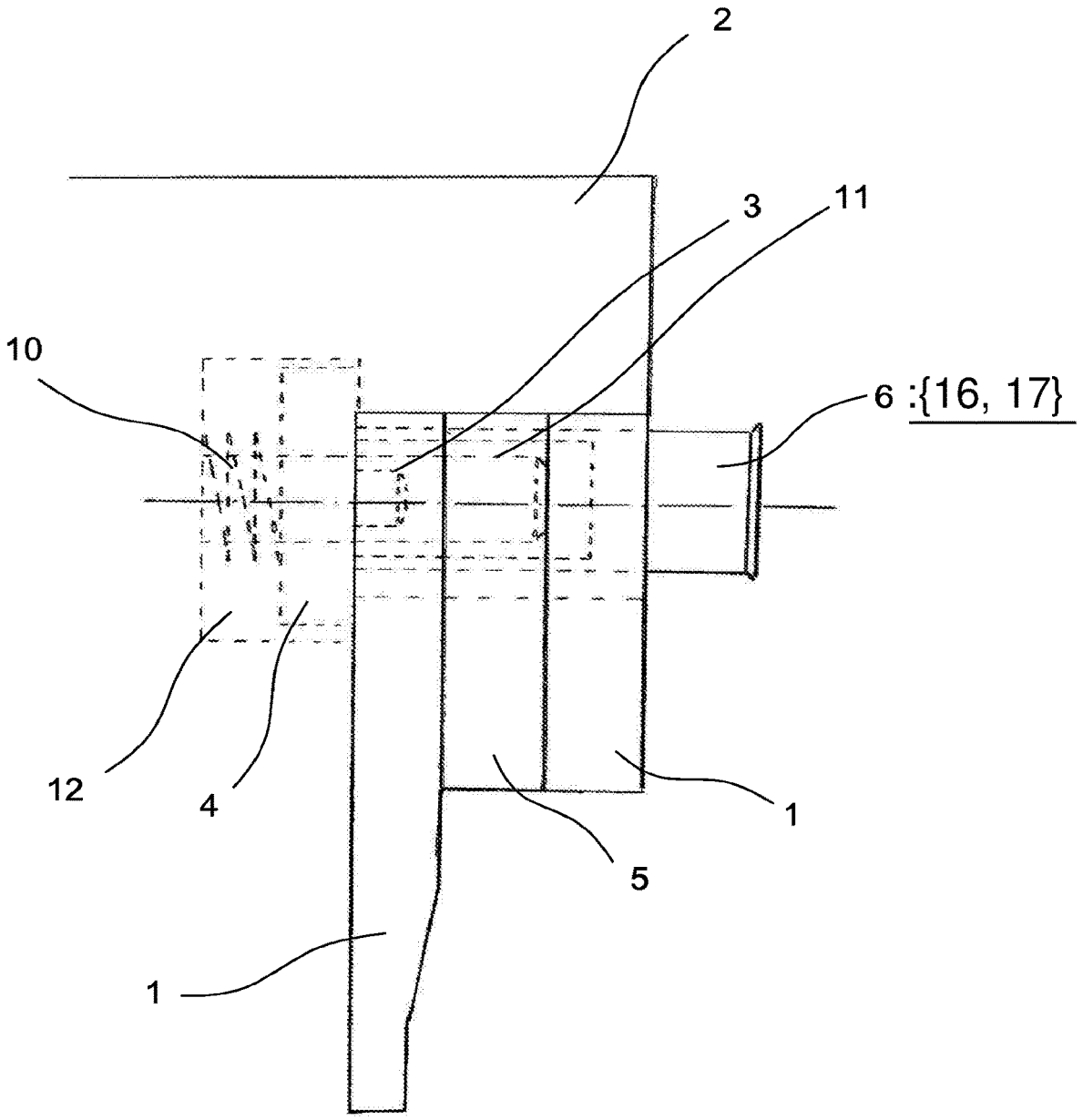
Figure 4:
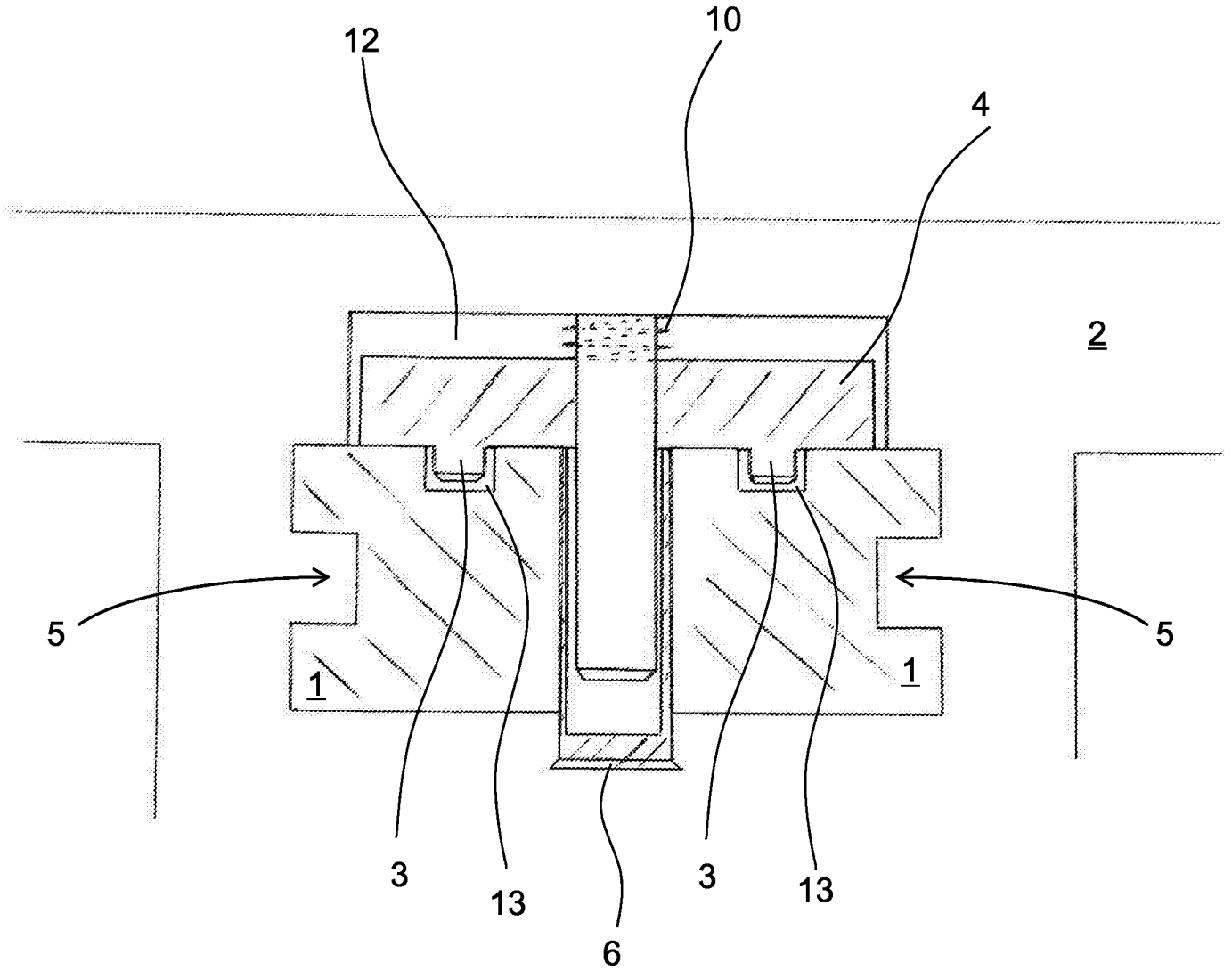
Figure 5:
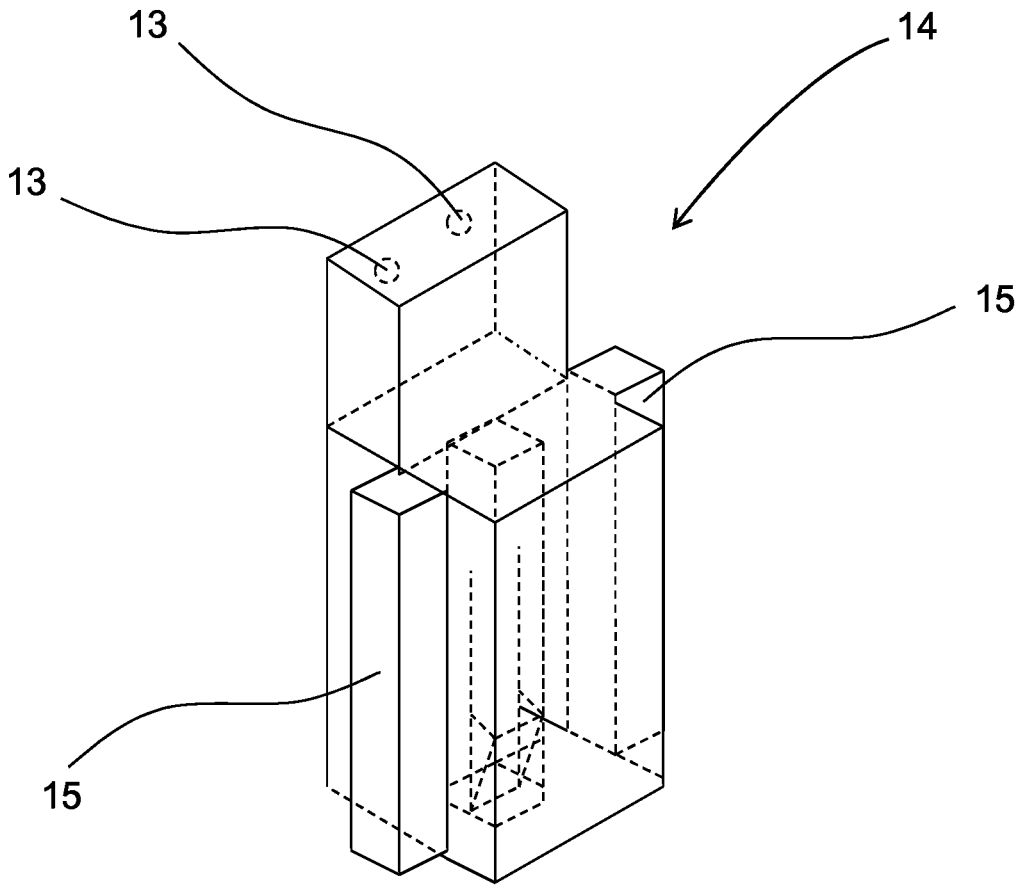
Figure 6:
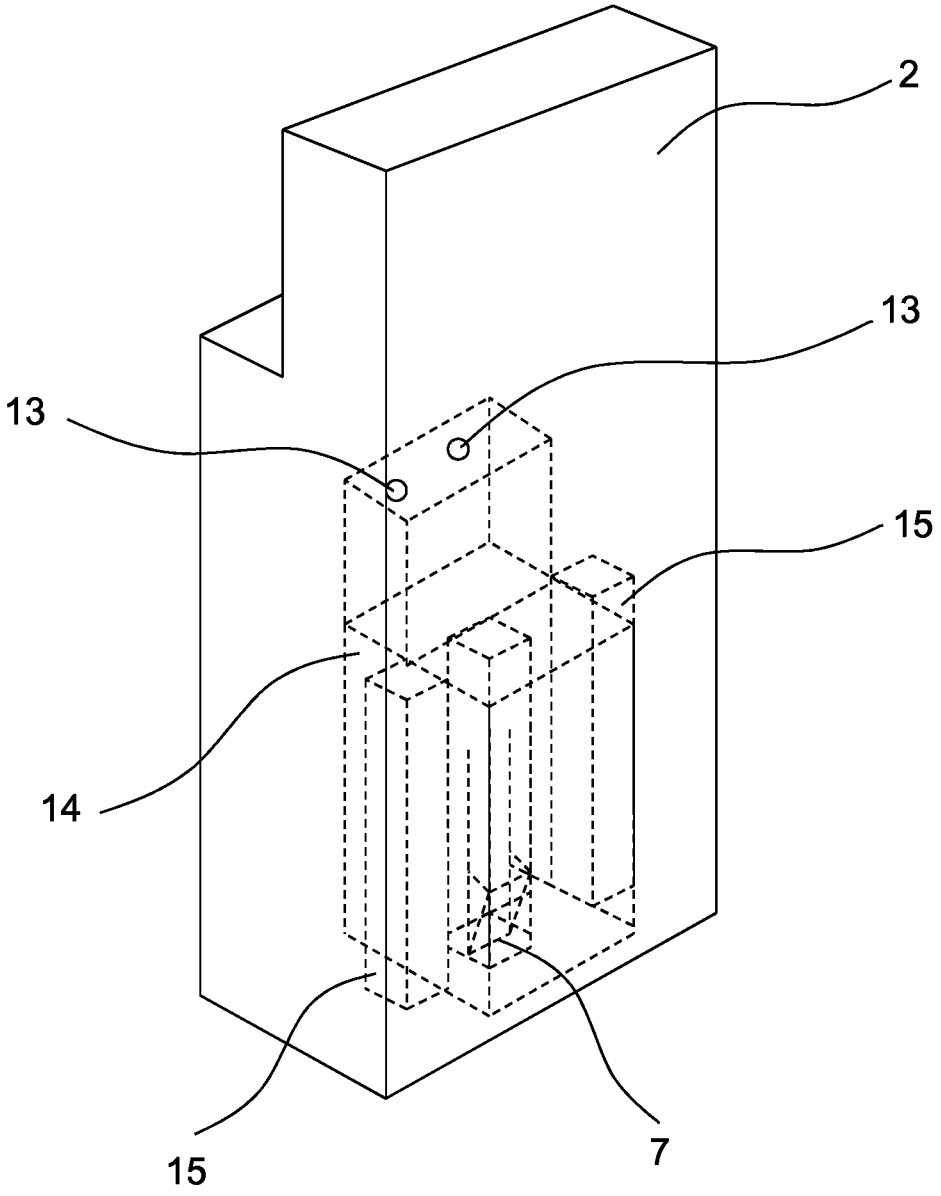

There are thus various possibilities for embodying and further developing the teachings of the present invention in advantageous ways. In addition, reference is made on one hand to the Claims subordinate to Claim 1, and on the hand, to the following explanation of preferred exemplary embodiments of the invention, based on the drawings. In conjunction with the explanations of the preferred exemplary embodiments of the invention based on the drawings, preferred designs and further developments of the teachings shall also be explained. In the drawings:

FIG. 1 shows, in a schematic view, partially, an exemplary embodiment of a device according to the invention, FIG. 2 shows, in a schematic view, an exemplary embodiment of a device according to the invention, wherein with respect to FIG. 1, the driving tool has been exchanged, FIG. 3 shows, in a schematic side view, an exemplary embodiment of a device according to the invention, FIG. 4 shows, in a schematic top view, an exemplary embodiment of a device according to the invention, FIG. 5 shows, in a perspective view, another exemplary embodiment of a driving tool, and FIG. 6 shows, in a perspective view, and exemplary embodiment of a stapling head having a driving tool retainer, in which the driving tool from FIG. 5 is inserted.

FIG. 1 shows a schematic view of an exemplary embodiment of a device according to the invention. The device for automatic stapling of printed products comprises a stapling head for driving staples through printed product backs and having an anvil for bending the free ends of the staple. The stapling head has a modular design, wherein the stapling head—in accordance with the exemplary embodiment of FIG. 1—comprises a driving tool 1 and a driving tool retainer 2, wherein the driving tool retainer 2 is equipped with the driving tool 1. The driving tool 1 is secured on the driving tool retainer 2 in an exchangeable manner. For this, locking bolts 3 are attached to a crosspiece 4 serving as a mount, and serve with the crosspiece 4 to attach the driving tool 1 to the driving tool retainer 2. Furthermore, a groove/feather key connection is provided on the driving tool 1 and on the driving tool retainer 2, by means of which the driving tool 1 is placed or inserted in the driving tool retainer 2. The driving tool 1 has in each case a groove 5 on the side, in which the feather key formed on the tool retainer engages for guidance. In order to secure it in the vertical direction, a spring lock is provided, which can be activated or deactivated via the button 6.

After releasing the spring lock via the button 6, the driving tool 1 can be removed from the driving tool retainer 2 via the groove/feather key connection, and if desired, replaced by another driving tool. The driving tool 1 according to FIG. 1 serves to strike a pre-shaped, conventional staple having a straight staple back with its striking edge 7 in order to drive it into a printed product back.

FIG. 2 shows a schematic view of another exemplary embodiment of a device according to the invention, wherein in differing from the exemplary embodiment in FIG. 1, a driving tool 8 for striking an eye-staple is placed in the driving tool retainer 2. The driving tool 8 has a recess 9 in the striking edge, which is adapted to an eyelet of an eye-staple.

FIG. 3 shows a schematic side view of an exemplary embodiment of a device according to the invention. The partially illustrated device comprises a stapling head having a driving tool retainer 2 in which a driving tool 1 is placed, wherein a modular coupling via groove/feather key connection is obtained. For this, the driving tool 1 according to the exemplary embodiment from FIG. 3 has a groove 5. The driving tool 1 is secured horizontally in the driving tool retainer 2. A spring lock having a spring 10 is provided in order to lock it in place vertically, which is actuated via a button 6. The crosspiece 4 having the locking bolts 3 can be moved thereby via a guide bolt 11. By sliding the crosspiece 3 into the hollow space 12, the locking bolts can be removed from the recesses of the driving tool 1, and the interlocking of the driving tool 1 in the driving tool retainer 2 is thus released.

FIG. 4 shows in a schematic top view, an exemplary embodiment of a device according to the invention, wherein a driving tool 1 is placed in a driving tool retainer 2. The driving tool 1 is secured vertically on the tool retainer 2 via a crosspiece 4 and locking bolts 3. The interlocking occurs via a spring lock comprising a spring 10, wherein the spring lock can be actuated by a button 6. By actuating the button 6, the crosspiece 4 and thus the locking bolts 3 can be moved via the guide bolt 11. By sliding the crosspiece 4 into the hollow space 12, the locking bolts 3 can be removed from the recesses 13 in the driving tool 1, and thus release the interlocking of the driving tool 1 in the driving tool retainer 2, such that the driving tool 1 can be removed from the driving tool retainer 2. The driving tool 1 comprises a groove in each of two opposing sides, which interacts with the feather keys of the driving tool retainer 2 for guidance.

FIG. 5 shows a perspective view of an exemplary embodiment of a driving tool 14. The driving tool 14 comprises recesses 13 for locking in place, or securing via corresponding locking bolts of the driving tool retainer that accommodates the driving tool. The driving tool 14 be designed as a driver module for driving a conventional staple into a printed product back, or as a driver module for driving an eye-staple into a printed product back. The driving tool 14 has—on each side—a projection in the form of a feather key 15. The feather keys 15 serve to engage in a corresponding groove in the driving tool retainer. By means of an upper stop, the height can be regulated when it is placed in the driving tool retainer.

FIG. 6 shows, in a perspective view, an exemplary embodiment of a stapling head according to the invention, having a driving tool retainer 2, in which the driving tool 14 according to FIG. 5 is installed. The driving tool retainer 2 according to the exemplary embodiment of FIG. 6 has a groove for guiding the feather key 15 of the driving tool 14. The driving tool retainer of the stapling head applies a force from above, via a mechanical or electrical drive, to the driving tool 14, for driving the staples out, or for driving the staples into the printed product backs. It is conceivable thereby that the driving tool 14 has a driver having a striking edge 7, which potentially can be extended from the driving tool 14, or having a striking edge that is provided with recesses adapted to an eye-staple.

The supplying of a staple wire can be obtained selectively via a wire coil or via a magazine containing pre-stamped wire. It is conceivable thereby that bending means are provided in the driving tool for shaping the wire, which pre-shape the staple that is to be driven, e.g. in the form of conventional staples or eye-staples. It is furthermore conceivable that pre-shaped staples, conventional or having eyelets, are already provided in a magazine.

In accordance with FIG. 6, the driving tool 14 is locked in place vertically via bolts, which extend into the recesses 13. Furthermore, the driving tool 14 can be secured in the driving tool retainer 2 via electrical or further mechanical components. The driving tool 14 has a striking edge or a striking edge having recesses, depending on the type of staple that is to be driven. Furthermore, it is possible to lock it in place via the feather key 15 on the driving tool retainer 2.

With regard to other advantageous designs of the device according to the invention, reference is made to the general description portion and the attached claims, in order to avoid repetition.

In order to create an interlocking that is easy to operate, the interlocking means can have a motorized design. By way of example, an interlocking aid can be implemented with a motor 16 and spindle 17.

Lastly, it is expressly stated that the exemplary embodiments of the device according to the invention described above serve merely to explain the claimed teachings, but these teachings are not limited to the exemplary embodiments.

LIST OF REFERENCE SYMBOLS

1 driving tool
2 driving tool retainer
3 locking bolt
4 crosspiece
5 groove
6 button
7 striking edge
8 driving tool
9 recess
10 spring
11 guide bolt
12 hollow space
13 recess
14 driving tool
15 feather key

The invention claimed is:

1. A device for stapling printed products, having a stapling head for driving a staple through a printed product back, and having an anvil for bending the free ends of the staple, wherein the stapling head has a modular design, wherein the stapling head comprises a driving tool and a driving tool retainer that is to be equipped with the driving tool, wherein the driving tool is secured on the driving tool retainer such that it can be exchanged, wherein the driving tool is placed and inserted into the driving tool retainer of the stapling head via a tongue-and-groove system, wherein the driving tool is retained on the driving tool retainer with a mount and at least one bolt, wherein the mount, the driving tool, or the mount and the driving tool can be locked in place on the driving tool retainer by an interlocking means, and wherein the interlocking means has a motorized design.

2. The device according to claim 1, wherein the driving tool has a substantially plate-shaped design.

3. The device according to claim 1, wherein the driving tool can be placed and inserted vertically into the stapling head, or into the driving tool retainer of the stapling head, respectively, via the tongue-and-groove system.

4. The device according to claim 1, wherein the driving tool has at least one hole, or recess for attachment to the driving tool retainer.

5. The device according to claim 1, wherein the interlocking means is designed as a releasable connecting means.

6. The device according to claim 5, wherein the connecting means comprises a screw connection, wing screw, spring interlocking, snap-in interlocking or quick-release clamp.

7. The device according to claim 1, wherein the interlocking means can be controlled by software.

8. The device according to claim 1, wherein the driving tool has a recess, or a hole, in the region of the interlocking means, wherein the hole, or the recess, is designed such that the interlocking means does not come in contact with the driving tool.

9. The device according to claim 1, wherein the driving tool retainer can be equipped with different driver modules serving as driving tools, wherein the different driver modules are each provided for striking or driving differently designed staples.

10. The device according to claim 1, wherein a driver module is provided as a driving tool for striking or driving a staple having a straight back part, and/or that a driver module is provided as a driving tool for striking a staple having an eyelet.

11. The device according to claim 10, wherein the staple is pre-shaped.

12. The device according to claim 1, wherein, depending on the desired type of staple, the appropriate driver module serving as a driving tool can be placed in the driving tool retainer in a modular manner.

13. The device according to claim 1, wherein a detection device is provided for identifying the driving tool.

14. The device according to claim 1, wherein a supplying of a staple wire occurs via a wire coil or via a magazine containing pre-stamped wire, wherein bending means are provided in the driving tool for shaping the wire, wherein the bending means pre-shape the staple that is to be driven.

15. The device according to claim 1, wherein the mount extends over the width of the driving tool.

16. The device according to claim 1, wherein the mount and/or the driving tool can be locked in place directly on the driving tool retainer by an interlocking means.

17. A stapling head, comprising a driving tool and a driving tool retainer that is to be equipped with the driving tool, wherein the driving tool is secured on the driving tool retainer such that it can be exchanged in a modular manner, wherein the driving tool is placed and inserted into the driving tool retainer of the stapling head via a tongue-and-groove system, wherein the driving tool is retained on the driving tool retainer with a mount and at least one bolt, wherein the mount, the driving tool, or the mount and driving tool can be locked in place on the driving tool retainer by an interlocking means, and wherein the interlocking means has a motorized design.

* * * * *